US008382317B1

(12) United States Patent
Baker

(10) Patent No.: US 8,382,317 B1
(45) Date of Patent: Feb. 26, 2013

(54) HAZARD WARNING LIGHT ASSEMBLY

(76) Inventor: James K. Baker, Toronto (CA)

( * ) Notice: Subject to any disclaimer, the term of this patent is extended or adjusted under 35 U.S.C. 154(b) by 280 days.

(21) Appl. No.: 12/838,073

(22) Filed: Jul. 16, 2010

(51) Int. Cl.
*F21S 4/00* (2006.01)

(52) U.S. Cl. ..... 362/225; 362/217.01; 362/217.1; 362/227; 362/249.02; 362/555

(58) Field of Classification Search ..... 362/217.01, 362/217.1, 217.14, 225, 227, 249.01–249.02, 362/551, 555, 559, 576
See application file for complete search history.

(56) References Cited

U.S. PATENT DOCUMENTS

| | | | | |
|---|---|---|---|---|
| 3,876,970 | A | 4/1975 | Schweitzer | |
| 5,036,447 | A | 7/1991 | Taylor | |
| 5,319,365 | A | 6/1994 | Hillinger | |
| 5,521,595 | A | 5/1996 | Totten et al. | |
| 5,630,660 | A | 5/1997 | Chen | |
| 5,788,361 | A * | 8/1998 | Lee | 362/249.16 |
| 6,135,623 | A | 10/2000 | Lin | |
| 6,265,969 | B1 | 7/2001 | Shih | |
| 6,899,441 | B2 | 5/2005 | Chen | |
| D506,942 | S | 7/2005 | Leung et al. | |
| 7,021,787 | B1 * | 4/2006 | Kuelbs | 362/183 |
| 7,182,479 | B1 | 2/2007 | Flood et al. | |

* cited by examiner

*Primary Examiner* — Meghan Dunwiddie

(57) ABSTRACT

A hazard warning light assembly includes a panel that has a top side and a bottom side. A receiver mount is attached to and extends upwardly from the top side. A stake has a top end, a bottom end and a perimeter wall extending between the top and bottom ends. The bottom end is pointed to allow the bottom end to be extendable into a ground surface. The receiver mount has a size and shape configured to receive the bottom end and support the stake in a vertical orientation. A plurality of primary light emitters is mounted to the stake. The primary light emitters are selectively turned on to emit light. A primary actuator is electrically coupled to the primary light emitters to turn the primary light emitters on or off.

10 Claims, 5 Drawing Sheets

HAZARD WARNING LIGHT ASSEMBLY

BACKGROUND OF THE DISCLOSURE

Field of the Disclosure

The disclosure relates to warning light devices and more particularly pertains to a new warning light device for serving as roadway signal warning which may be used to warn oncoming vehicles to drive carefully.

SUMMARY OF THE DISCLOSURE

An embodiment of the disclosure meets the needs presented above by generally comprising a panel that has a top side and a bottom side. A receiver mount is attached to and extends upwardly from the top side. A stake has a top end, a bottom end and a perimeter wall extending between the top and bottom ends. The bottom end is pointed to allow the bottom end to be extendable into a ground surface. The receiver mount has a size and shape configured to receive the bottom end and support the stake in a vertical orientation. A plurality of primary light emitters is mounted to the stake. The primary light emitters are selectively turned on to emit light. A primary actuator is electrically coupled to the primary light emitters to turn the primary light emitters on or off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
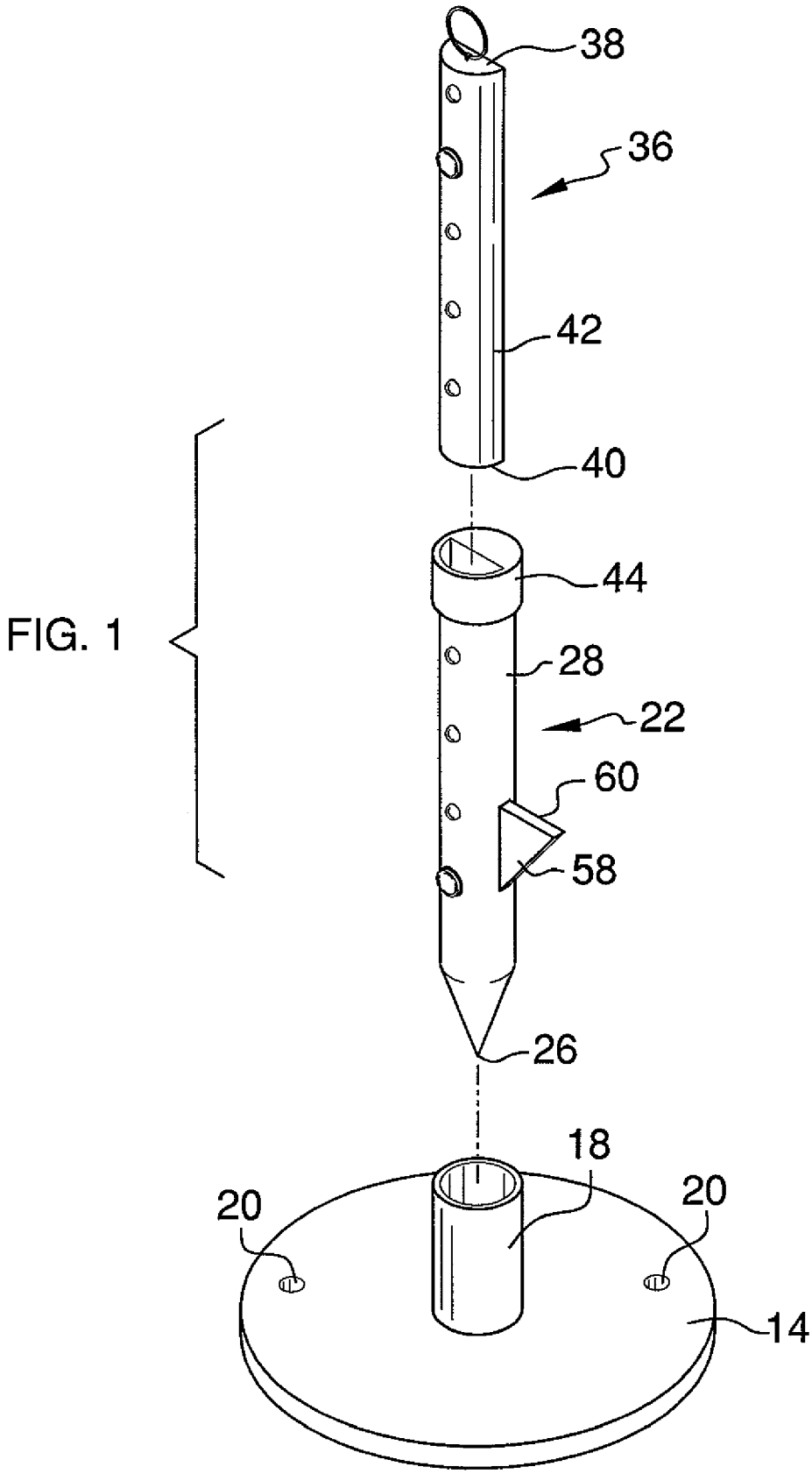
FIG. 1 is a top perspective view of a hazard warning light assembly according to an embodiment of the disclosure.
Figure 2:
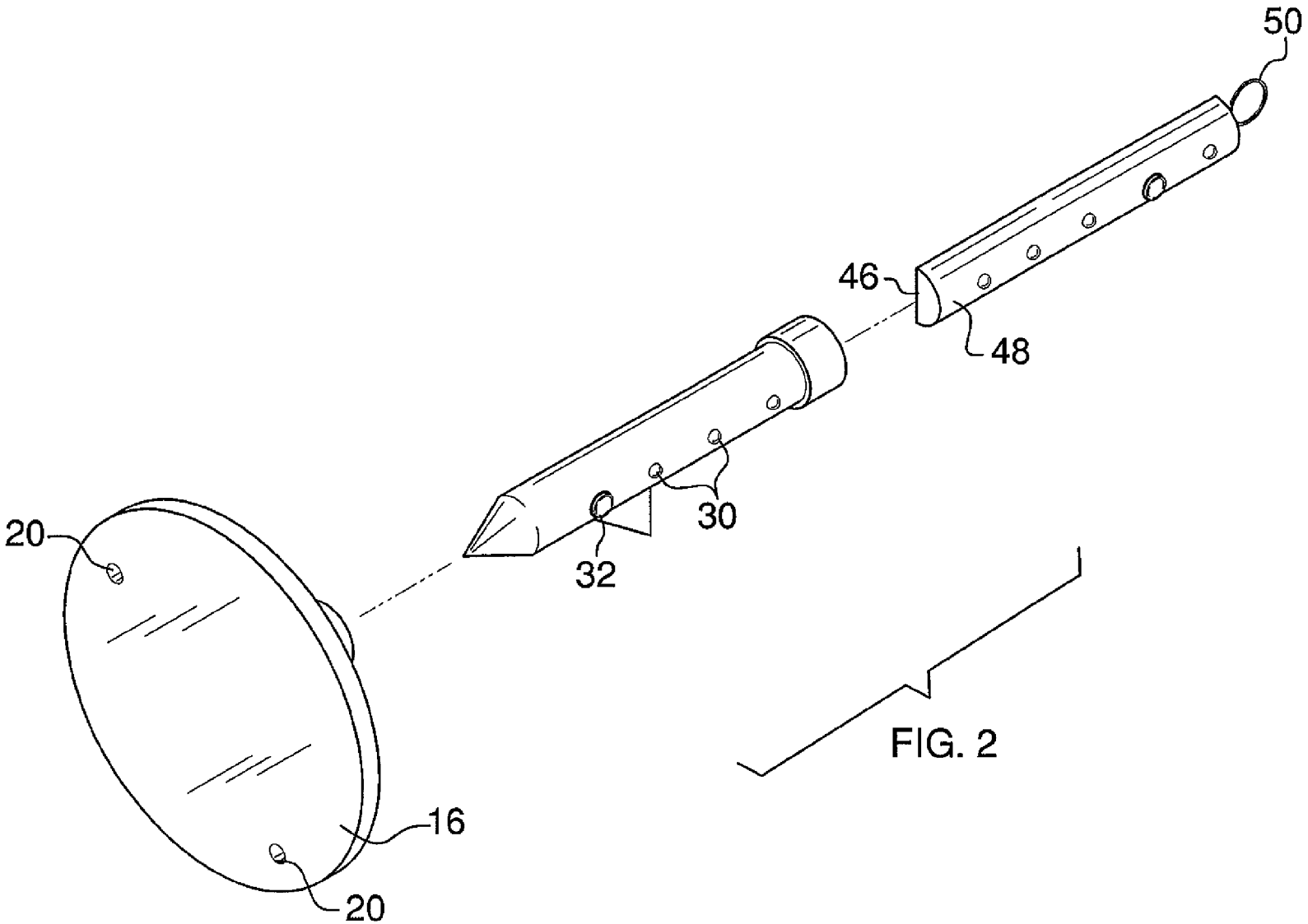
FIG. 2 is a bottom perspective view of an embodiment of the disclosure.
Figure 3:
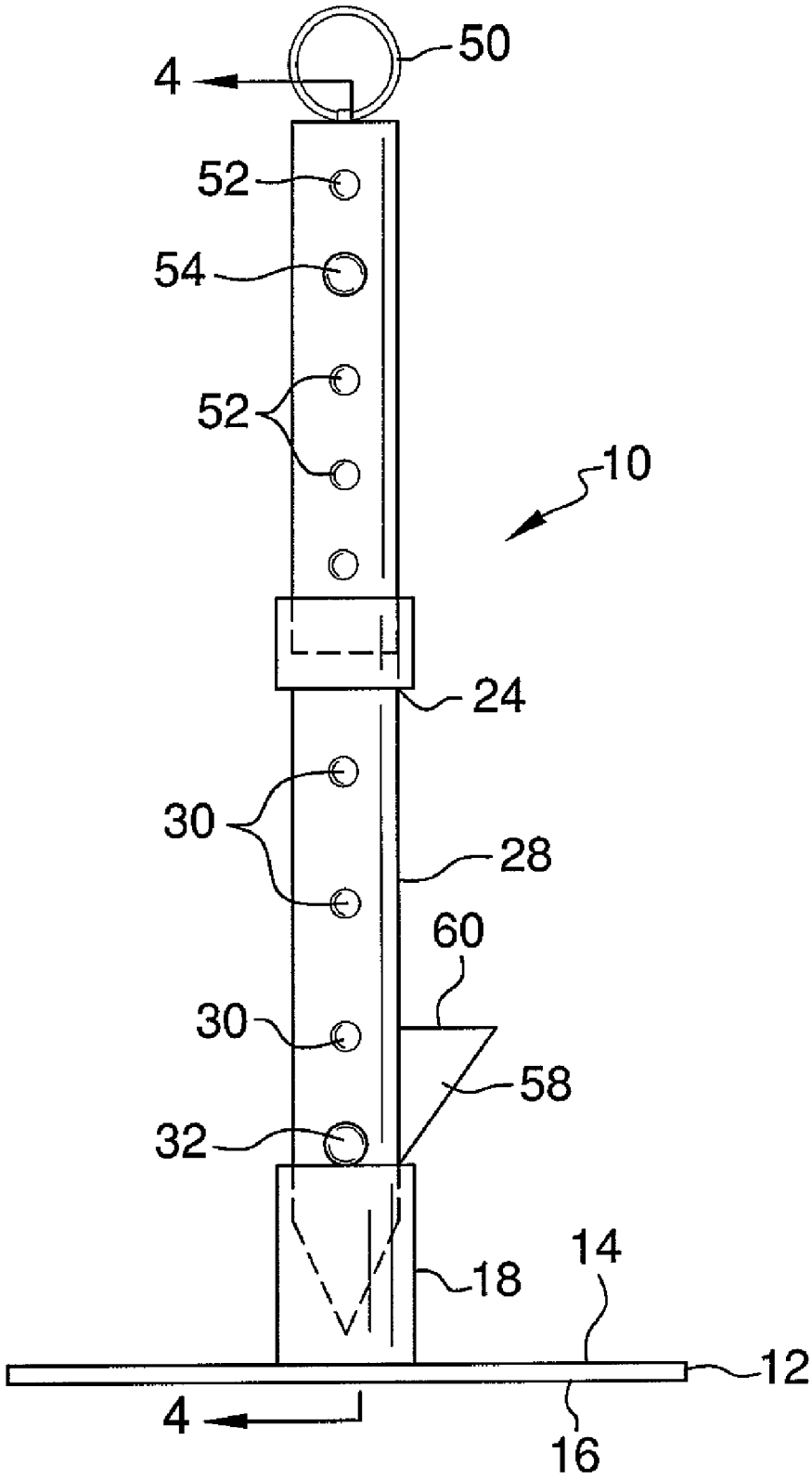
FIG. 3 is a front view of an embodiment of the disclosure.

With reference now to the drawings, and in particular to FIGS. 1 through 5 thereof, a new warning light device embodying the principles and concepts of an embodiment of the disclosure and generally designated by the reference numeral 10 will be described.

As best illustrated in FIGS. 1 through 5, the hazard warning light assembly 10 generally comprises a panel 12 that has a top side 14 and a bottom side 16. A receiver mount 18 is attached to and extends upwardly from the top side 14. The panel 12 has a plurality of openings 20 therein extending into the top side 14 and outwardly of the bottom side 16.

A stake 22 has a top end 24, a bottom end 26 and a perimeter wall 28 extending between the top 24 and bottom 26 ends. The bottom end 26 is pointed to allow the bottom end 26 to be extendable, by a driving force, into a ground surface. The receiver mount 18 has a size and shape configured to receive the bottom end 26 and support the stake 22 in a vertical orientation.

A plurality of primary light emitters 30, which may be light emitting diodes, is mounted to the stake 22. The primary light emitters 30 are selectively turned on to emit light. A primary actuator 32 is electrically coupled to the primary light emitters 30 to turn the primary light emitters 30 on or off. The primary light emitters 30 flash when the primary light emitters 30 are turned on. One or more batteries 34 may be mounted within the stake to power the primary light emitters 30.

A post 36 has an upper end 38, a lower end 40 and a peripheral wall 42 extending between the upper 38 and lower ends 40. A coupler 44 releasably couples the lower end 38 to the top end 24 to support the post 36 in a vertically orientation extending upwardly from the stake 22. The peripheral wall 42 includes a planar surface 46 and an arcuate surface 48 so that the post 36 has a semi-circular cross-section taken perpendicular to a longitudinal axis of the post 36 extending through the upper 38 and lower 40 ends. The planar surface 46 allows the post 36 to lie, in a stable manner, on a ground or other support surface. Each of the post 36 and the stake 22 has a height when vertically orientated between 7 inches and 15 inches. Additionally, each of the post 36 and the stake 22 is comprised of a transparent material. A ring 50 is attached to the upper end 38 to facilitate hanging of the post 36 on an object.

A plurality of secondary light emitters 52, which may be light emitting diodes, is mounted to the post 36. The secondary light emitters 52 are selectively turned on to emit light. A secondary actuator 54 is electrically coupled to the secondary light emitters 52 to turn the secondary light emitters 52 on or off. The secondary light emitters 52 flash when the secondary light emitters 52 are turned on. One or more batteries 56 is electrically coupled to the secondary light emitters 52 to provide power to the secondary light emitters 52.

A striking plate 58 is attached to the perimeter wall 28 and extends laterally away from the stake 22. The striking plate 58 is configured to be struck by a hammer to facilitate extension of the bottom end 26 into the ground surface. The striking plate 58 may be triangular shaped with an upper edge 60 being orientated perpendicular to a longitudinal axis of the stake 22.

Figure 4:
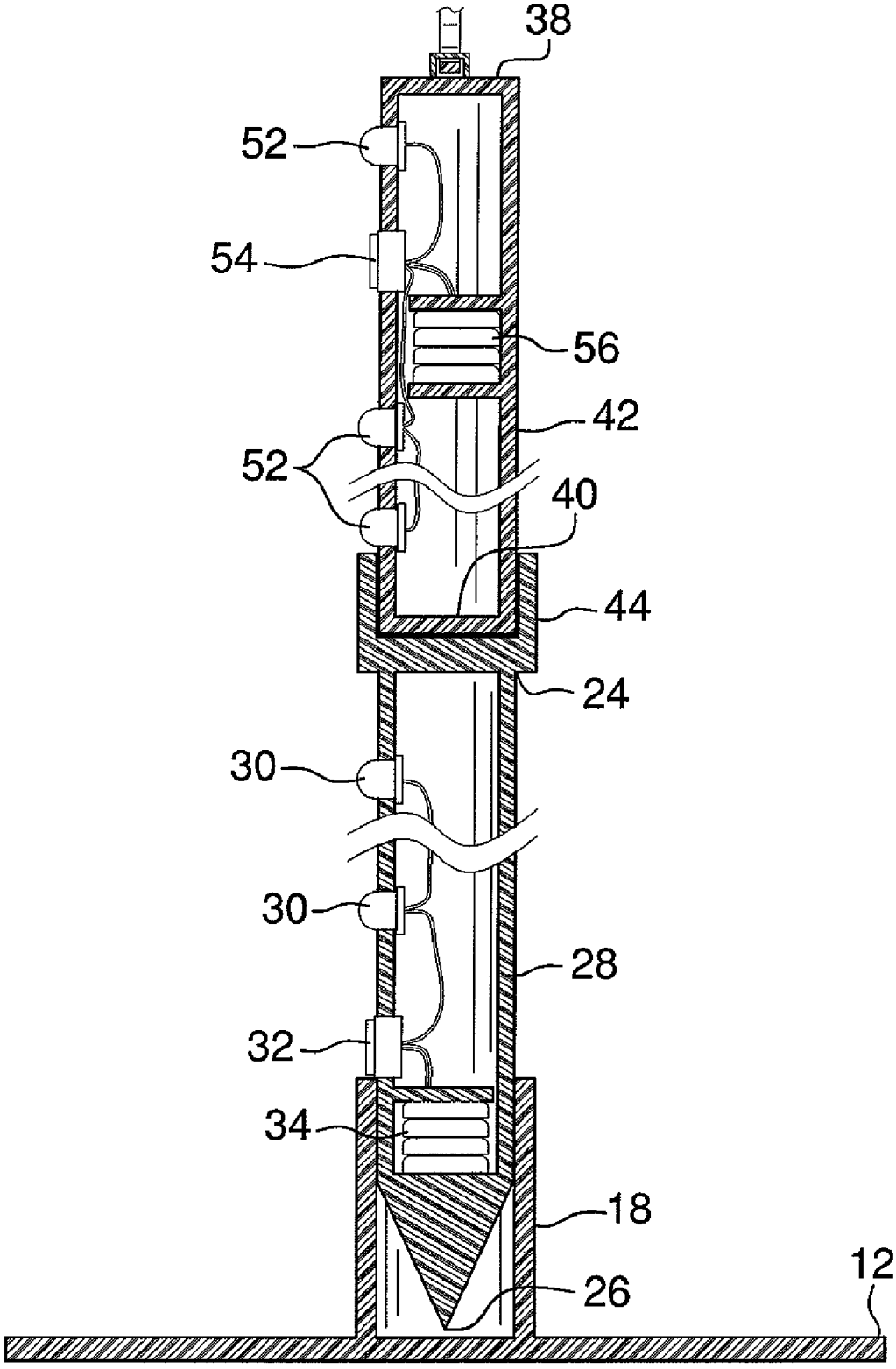
FIG. 4 is a cross-sectional view of an embodiment of the disclosure taken along line 4-4 of FIG. 3.
Figure 5:
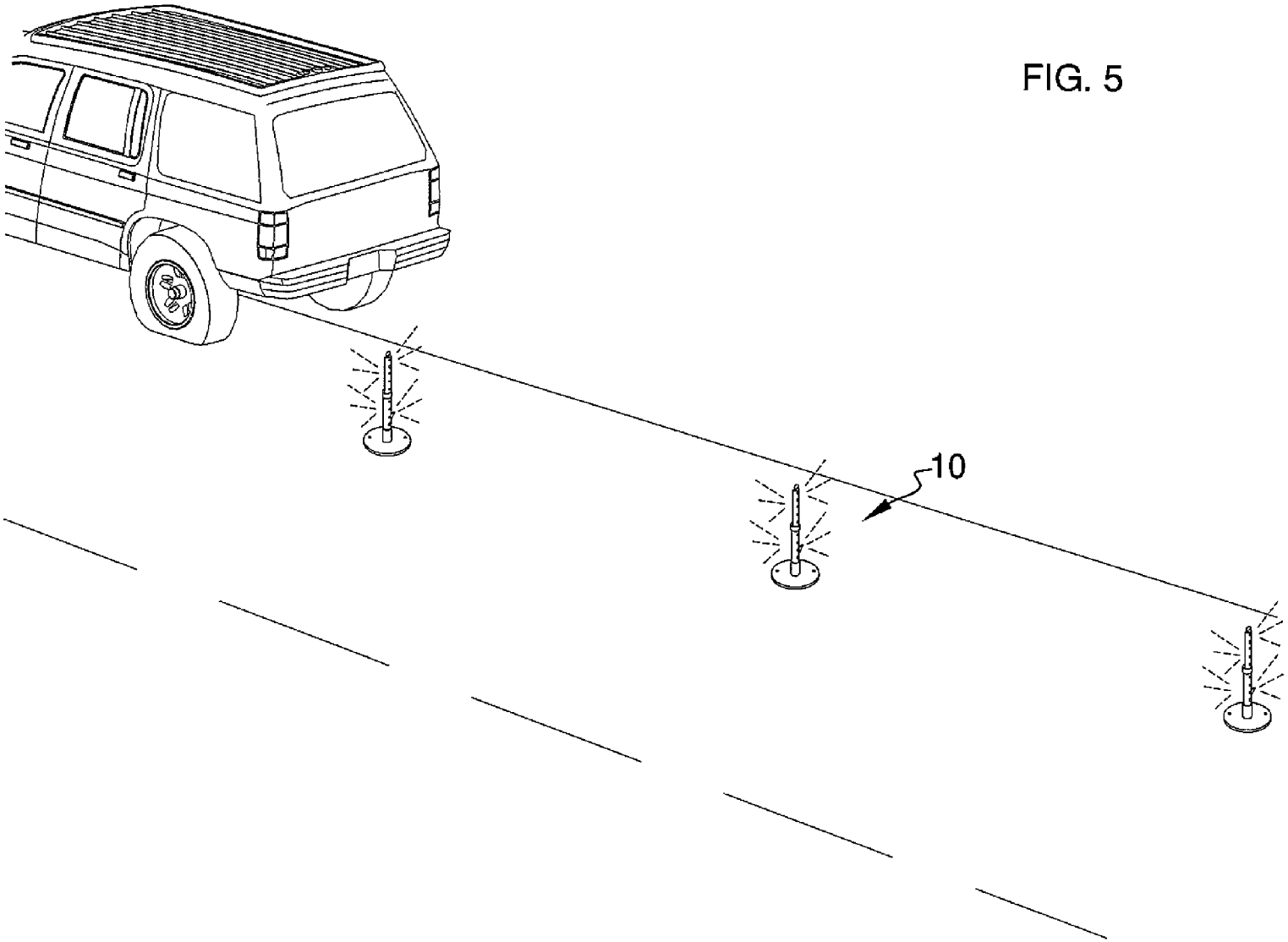
FIG. 5 is a perspective in-use view of an embodiment of the disclosure.

In use, the stake 22 may be extended into the receiving mount 18 as shown in FIG. 4. If the user would prefer a taller structure, the post 36 may be positioned in the stake 22. The light emitters 30, 52 may then be turned on to provide a warning signal such as to oncoming vehicles. If desired, nails or other like device may be extended through the openings 20 to stabilize the panel 12. Alternatively, if the ground surface is malleable, the stake 22 may be driven directly into the ground surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hazard warning system comprising:

a panel having a top side and a bottom side, a receiver mount being attached to and extending upwardly from said top side, said panel having a plurality of openings therein extending into said top side and outwardly of said bottom side;

a stake having a top end, a bottom end and a perimeter wall extending between said top and bottom ends, said bottom end being pointed to allow said bottom end to be extendable into a ground surface, said receiver mount having a size and shape configured to receive said bottom end and support said stake in a vertical orientation; and a plurality of primary light emitters being mounted to said stake, said primary light emitters being selectively turned on to emit light, a primary actuator being electrically coupled to said primary light emitters to turn said primary light emitters on or off.

2. The system according to claim 1, further including:

a post having an upper end, a lower end and a peripheral wall extending between said upper and lower ends, a coupler releasably coupling said lower end to said top end to support said post in a vertically orientation extending upwardly from said stake; and a plurality of secondary light emitters being mounted to said post, said secondary light emitters being selectively turned on to emit light, a secondary actuator being electrically coupled to said secondary light emitters to turn said secondary light emitters on or off.

3. The system according to claim 2, wherein said peripheral wall includes a planar surface and an arcuate surface such that said post has a semi-circular cross-section taken perpendicular to a longitudinal axis of said post extending through said upper and lower ends.

4. The system according to claim 1, further including a striking plate being attached to said perimeter wall and extending laterally away from said stake, said striking plate being configured to be struck by a hammer to facilitate extension of said bottom end into a ground surface.

5. The system according to claim 2, further including a ring being attached to said upper end to facilitate hanging of said post on an object.

6. A hazard warning system comprising:

a panel having a top side and a bottom side, a receiver mount being attached to and extending upwardly from said top side, said panel having a plurality of openings therein extending into said top side and outwardly of said bottom side;

a stake having a top end, a bottom end and a perimeter wall extending between said top and bottom ends, said bottom end being pointed to allow said bottom end to be extendable into a ground surface, said receiver mount having a size and shape configured to receive said bottom end and support said stake in a vertical orientation;

a plurality of primary light emitters being mounted to said stake, said primary light emitters being selectively turned on to emit light, a primary actuator being electrically coupled to said primary light emitters to turn said primary light emitters on or off, said primary light emitters flashing when said primary light emitters are turned on;

a post having an upper end, a lower end and a peripheral wall extending between said upper and lower ends, a coupler releasably coupling said lower end to said top end to support said post in a vertically orientation extending upwardly from said stake, said peripheral wall including a planar surface and an arcuate surface such that said post has a semi-circular cross-section taken perpendicular to a longitudinal axis of said post extending through said upper and lower ends, each of said post and said stake having a height when vertically orientated between 7 inches and 15 inches, each of said post and said stake being comprised of a transparent material;

a plurality of secondary light emitters being mounted to said post, said secondary light emitters being selectively turned on to emit light, a secondary actuator being electrically coupled to said secondary light emitters to turn said secondary light emitters on or off, said secondary light emitters flashing when said secondary light emitters are turned on;

a striking plate being attached to said perimeter wall and extending laterally away from said stake, said striking plate being configured to be struck by a hammer to facilitate extension of said bottom end into the ground surface; and a ring being attached to said upper end to facilitate hanging of said post on an object.

7. A hazard warning system comprising:

a panel having a top side and a bottom side, a receiver mount being attached to and extending upwardly from said top side;

a stake having a top end, a bottom end and a perimeter wall extending between said top and bottom ends, said bottom end being pointed to allow said bottom end to be extendable into a ground surface, said receiver mount having a size and shape configured to receive said bottom end and support said stake in a vertical orientation;

a plurality of primary light emitters being mounted to said stake, said primary light emitters being selectively turned on to emit light, a primary actuator being electrically coupled to said primary light emitters to turn said primary light emitters on or off; and a striking plate being attached to said perimeter wall and extending laterally away from said stake, said striking plate being configured to be struck by a hammer to facilitate extension of said bottom end into a ground surface.

8. The system according to claim 7, further including:

a post having an upper end, a lower end and a peripheral wall extending between said upper and lower ends, a coupler releasably coupling said lower end to said top end to support said post in a vertically orientation extending upwardly from said stake; and a plurality of secondary light emitters being mounted to said post, said secondary light emitters being selectively turned on to emit light, a secondary actuator being electrically coupled to said secondary light emitters to turn said secondary light emitters on or off.

9. The system according to claim 8, wherein said peripheral wall includes a planar surface and an arcuate surface such that said post has a semi-circular cross-section taken perpendicular to a longitudinal axis of said post extending through said upper and lower ends.

10. The system according to claim 7, further including a ring being attached to said upper end to facilitate hanging of said post on an object.

* * * * *